US005582408A

United States Patent [19]

Hofmann

[11] Patent Number: 5,582,408

[45] Date of Patent: Dec. 10, 1996

[54] PLAYING FIGURE FOR A BALL GAME PLAYABLE ON A TABLE, PARTICULARLY A TABLE FOOTBALL GAME

[75] Inventor: Willy Hofmann, Niederwenigen, Switzerland

[73] Assignee: G.S.G. Global Sports Establishment, Liechtenstein, Switzerland

[21] Appl. No.: 300,785

[22] Filed: Sep. 2, 1994

[30] Foreign Application Priority Data

Sep. 6, 1993 [CH] Switzerland ..... 02634/93

[51] Int. Cl.[6] ..... A63F 7/06; A63F 7/20

[52] U.S. Cl. ..... 273/317.5; 273/108.1; 273/108.4; 273/108.5

[58] Field of Search ..... 273/288, 289, 273/290, 291, 94, 85 R, 37.5, 108.1, 108.4, 108.5; D21/51, 52

[56] References Cited

U.S. PATENT DOCUMENTS

| | | | |
|---|---|---|---|
| D. 169,230 | 3/1953 | Wade | 273/288 |
| 361,721 | 4/1887 | Schitthenner | 273/291 |
| 2,245,830 | 6/1941 | Sheffield | 273/94 R |
| 2,713,489 | 7/1955 | Glaser | 273/94 R |
| 3,945,640 | 3/1976 | Denmark . | |
| 4,211,408 | 7/1980 | Tickle . | |
| 4,249,740 | 2/1981 | Cheney | 273/288 |

FOREIGN PATENT DOCUMENTS

| | | | |
|---|---|---|---|
| 261408 | 8/1949 | France . | |
| 189301 | 11/1922 | United Kingdom . | |
| 457161 | 11/1936 | United Kingdom | 273/85 R |
| 495427 | 11/1938 | United Kingdom | 273/85 R |
| 616782 | 1/1949 | United Kingdom . | |
| 634857 | 3/1950 | United Kingdom | 273/85 R |
| 733424 | 1/1955 | United Kingdom . | |
| 2050846 | 1/1981 | United Kingdom . | |
| 2209958 | 1/1989 | United Kingdom . | |

*Primary Examiner*—Sebastiano Passaniti

*Attorney, Agent, or Firm*—Tarolli, Sundheim, Covell, Tummino & Szabo

[57] ABSTRACT

The invention is based on a playing figure for a ball game playable on a table, particularly for a table football game, in which said playing figure (1) has a disk-like base (3) rotationally symmetrical about a base axis and having a base diameter (D1) and a base height (H1), as well as a figure (2), the base (3) being bounded on its bottom by a planar base lower surface (10) having a diameter (D2) and on its top by a base upper surface (7) bordered by a base upper edge (8) and on which the figure (2), extending in the direction of the base axis is fitted. In the case of such a playing figure (1) an improved playability is brought about in that the diameter (D2) of the base lower surface (10) is more than 55% and up to substantially 100% of the base diameter (D1).

17 Claims, 1 Drawing Sheet

PLAYING FIGURE FOR A BALL GAME PLAYABLE ON A TABLE, PARTICULARLY A TABLE FOOTBALL GAME

TECHNICAL FIELD

The present invention relates to toys. It deals with a playing figure for a ball game playable on a table, particularly for a table football game, said playing figure having a disk-like base rotationally symmetrical about a base axis, having a base diameter and a base height, together with a figure, the base being bounded on its bottom by a planar lower surface having a diameter and on its top by an upper surface bordered by a base upper edge, the figure, extending in the direction of the base axis, being fitted to the upper surface of the base. Such a playing figure is e.g. known from British patent 616,782.

PRIOR ART

To an ever increasing extent and in many countries a table football game has been played for many years, which simulates field football and on the one hand makes high demands on the skills of the players and on the other permits a variant-rich game permitting numerous special moves.

Playing takes place on a planar surface of table size on which are drawn the white lines of a football pitch. On the transverse sides of the playing surface are provided goals having the standard size. Normally two persons play against one another and in each case have available 11 playing figures, i.e. a goalkeeper and 10 other players. Whereas the goalkeeper is moved in the goal area by means of a rod passing through below the rear wall of the goal in order to save shots, the players on the pitch are freely movable over the playing surface.

The playing figures comprise a figure mounted on a base and form a rigid unit. The usually spherical ball is played in that a playing figure is so snapped forwards with the finger that the base strikes the ball in the desired manner. As a result of a special design of the base or playing figure and a planned snapping action the playing figure can also cover curved paths on the playing surface or perform jumps, so that it can pass round opposing playing figures or strike the ball e.g. backwards. The playing figure performs complicated, staggering (precessing) movements, which are greatly dependent on its design, more especially the geometrical details and weight distribution.

From the aforementioned document from the initial stages of table football playing figures are proposed (FIGS. 1 and 2), which have a solid, substantially hemispherical base, to which is fitted a flat figure cut from cardboard or celluloid. The base comprises a light plastics material and can additionally be weighted with a weight. It is preferably slightly flattened on the underside, the diameter ratio of the resulting lower to upper surface of the base being well below 0.5.

Such playing figures have not proved very successful in practice, because as a result of their weight distribution and base geometry although they are suitable for performing staggering movements, they cannot play in a straight line over significant distances, which greatly restricts playing possibilities. In particular, due to the unfavourable weight ratios, the necessary momentum cannot be transferred to the ball.

Thus, during the further development of the game, the hemispherical base has taken the place of the solid base and is closed at the top with a cover carrying the figure and in its interior it has an additional weight in the form of a metal ring or metal plate. The additional weight ensures a lower centre of gravity and stabilizes the movement of the playing figure. This weighting effect is also necessary because the figures fitted to the base have a relatively high weight in their true-to-life design and the bases are generally either round or only have a relatively small bearing surface on the bottom. First developments of such playing figures with hollow bases are disclosed in British patents 1 334 133, 1 415 344 and 1 516 610, or U.S. Pat. No. 3,945,640. For non-competitive games, playing figures such as are e.g. described in U.S. Pat. No. 4,211,408 have largely been adopted. However, for competitive games these figures must be additionally prepared in order to satisfy higher demands.

The nowadays almost exclusively used playing figures with a hollow base, additional weight and solid figure on the base suffer from various disadvantages. Firstly they comprises a comparatively large number of individual parts, which not only have to be accurately fitted together, but must be reliably interconnected by taking special precautions and using fastening means (so that numerous of the aforementioned documents deal with the assembly problem). In addition, the geometrical design of the base and the figure, as well as the weight distribution are such that even a skilled player can only carry out with difficulty demanding, planned moves. This is clearly due to the fact that when the playing figures are tilted out of the normal position by a small angle only a relatively limited resiliency is developed and they tend to oscillate, i.e. only reassume their inoperative position after a number of movements backwards and forwards, or alternatively fall over. The conditions are particularly unfavourable if the bottom of the base is only slightly or not flattened.

DESCRIPTION OF THE INVENTION

The problem of the invention is to provide a playing figure, which is able to meet high demands with respect to playability and which at the same time has a simple construction and is easily manufactured.

In the case of a playing figure of the aforementioned type this problem is solved in that the diameter of the lower surface of the base is more than 55% and up to virtually 100% of the base diameter.

Contrary to the ideas adopted up to now the invention no longer uses a playing figure with the problematical hollow base and instead has further developed the original solid base, in that on the bottom of the base is provided a planar lower surface, whose diameter exceeds a certain critical limit relative to the base diameter. This surprisingly leads to a playing figure, which combines the positive characteristics of the "cork-tumbler/skip-jack" concept based on a round base with the positive characteristics of the playing disk or counter concept based on a flat disk base. This playing figure has playing characteristics which from the quality standpoint exceed what has become known up to now and in particular offers the experienced player an optimum control of the ball and therefore permits precisely defined and accurately realizable playing.

A first embodiment of the playing figure according to the invention is characterized in that the weight of the base is formed by the base material, that the base is made from a solid material and that the base is constructed in one piece.

A second, preferred embodiment of the playing figure according to the invention is characterized in that the upper edge of the base is inclined in the manner of a bevel and has a width, which is between 15 and 40%, preferably approximately 27% of the base height. The bevelled upper edge of the base permits an optimum momentum transfer between the playing figure and the played ball. In particular, the stability of the figure following the momentum transfer to the ball is decisively improved.

In addition, preference is given to two base variants. The first is characterized in that the diameter of the lower surface of the base is between 57 and 76%, preferably approximately 66% of the base diameter and that the base is outwardly bounded between the base upper edge and the base lower surface by an all-round base rounding, whose rounding radius r is preferably approximately 38% of the base diameter. This first variant is more particularly of interest for competitive use, because the rounding allows a particularly large number of moves to be made.

The second variant is characterized in that the diameter of the lower surface of the base is virtually 100% of the base diameter, that between the base upper edge and the base lower surface is provided a perpendicular, all-round base rim, which links the base upper edge with the base lower surface and that a bevel is provided at the transition between the base rim and the base lower surface. This second variant is of particular interest if, to the detriment of the playing possibilities, interest is mainly attached to a stable movement of the playing figure, so as to make it more easily possible for the beginner to become well acquainted with the game.

A further preferred embodiment of the invention is characterized in that the base height is between 20 and 27%, preferably approximately 26.2% of the base diameter, that the figure has a height which is between 125 and 180%, preferably approximately 147% of the base diameter and that the weight of the figure is no more than 12.5%, particularly between 8 and 9% of the weight of the base.

Further embodiments can be gathered from the dependent claims.

BRIEF DESCRIPTION OF THE DRAWINGS

The invention is described in greater detail hereinafter relative to non-limitative embodiments and the attached drawings, wherein show.

WAYS TO PERFORM THE INVENTION

Figure 1A:
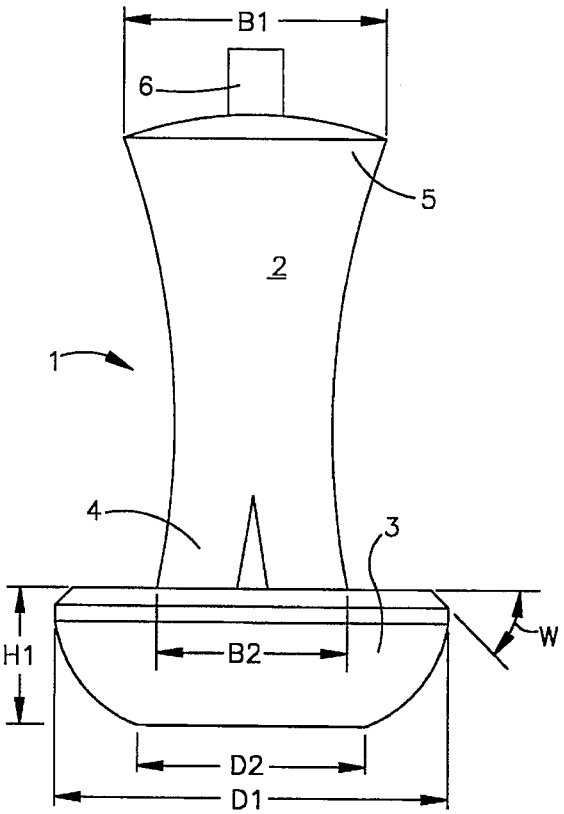
FIG. 1 in front and side view (a and b) a preferred embodiment of the playing figure according to the invention with a first base variant.
Figure 1B:
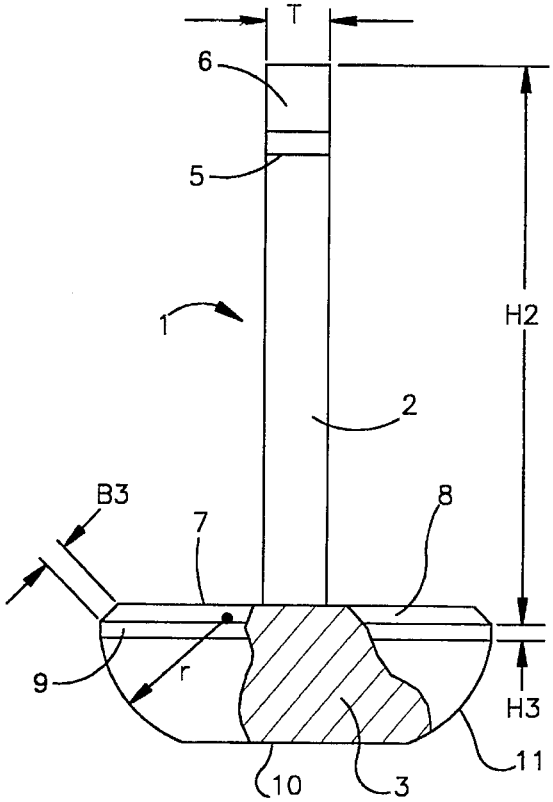

FIG. 1 shows a particularly preferred embodiment of a playing figure according to the invention in front view (FIG. 1*a*) and in side view (FIG. 1*b*). The playing FIG. 1 substantially comprises a disk-like base 3, rotationally symmetrical about a base axis and having a base diameter D1 and a base height H1, as well as a FIG. 2. The base 3 is bounded on its bottom by a circular, planar base lower surface 10 having a diameter D2. On the top the base 3 is bounded by a preferably planar, circular base upper surface 7, which is bordered by an all-round base upper edge 8 and to which is fixed the FIG. 2.

The base upper edge 8 is important for momentum transfer between the base and the ball when shooting. It is inclined in the manner of a bevel and has a width B3, which is between 15 and 40% of the base height H1 and is preferably 27% of the base height. With the horizontal the base upper edge 8 forms an angle w between 40 and 80° and which is preferably 61.5°. Between the base upper edge 8 and the base lower surface 10 the base 3 is outwardly bounded by an all-round base rounding 11, whose rounding radius r is preferably approximately 38% of the base diameter D1.

At the top the base rounding 11 can directly abut with the base upper edge 8. However, particularly favourable playing characteristics of the playing FIG. 1 are obtained if, between the base upper edge 8 and the base rounding 11, is provided a perpendicular, all-round base rim 9, which has a height H3, which is 3 to 30%, preferably approximately 3.6% of the base height HI.

What is decisive for playability is the dimensioning of the base lower surface 10 compared with the base diameter D1. According to the invention the diameter D2 of the base lower surface 10 is more than 55% and up to 100% of the base diameter D1. Whilst the limmit D2≈D1 is obtained for the variant of the playing FIG. 1 shown in FIG. 2, for that shown in FIG. 1 the value of D2 is between 57 and 76% and in optimum manner is approximately 0.66D1 (66%). These diameter ratios lead to an optimum compromise between the "flat" and "round" base. The ratio of the base diameter D1 to the base height H1 is also important for playability and in particular stability. Favourable results for both playing figure variants are obtained if the base height H1 is between 20 and 27%, preferably approximately 26.2% of the base diameter D1.

The base 3 is preferably solid and is made from a polystyrene PS (according to DIN 53 479) having a density of 1.05 g/cm$^3$. As the dynamic characteristics of the playing figure are decisively dependent on the weight distribution between the figure and the base and the geometrical dimensions of both parts, it is also important to respect specific weight and size ratios. For a base of the indicated type preferably use is made of a stylized FIG. 2, which has a height H2, which is between 125 and 180%, preferably approximately 147% of the base diameter D1.

Figure 2A:
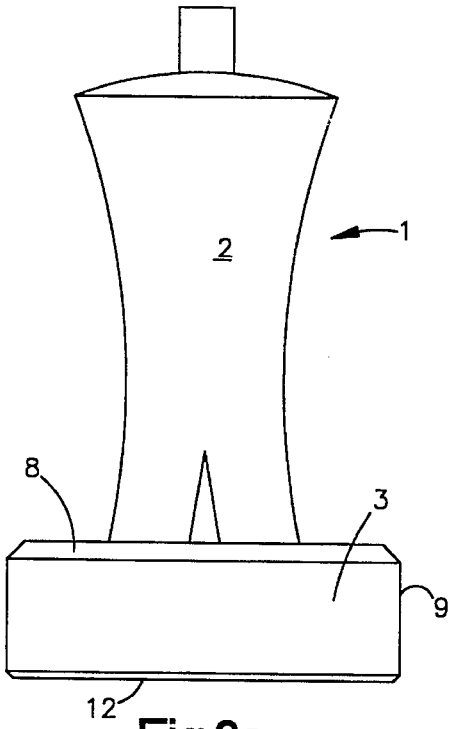
FIG. 2 in front and side view (a and b) a preferred embodiment of the playing figure according to the invention with a second base variant.
Figure 2B:
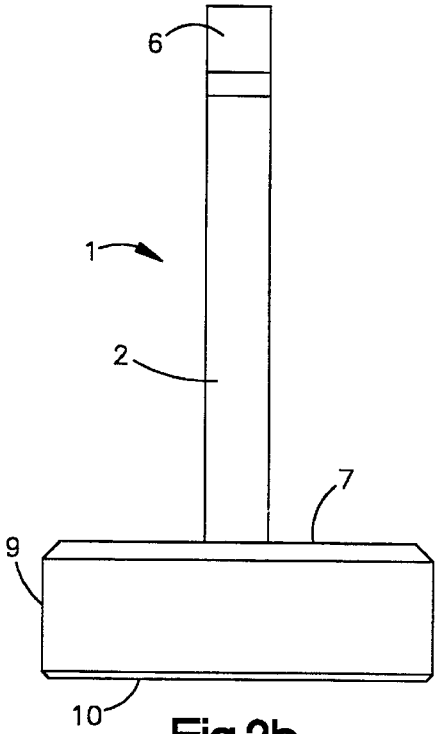

The FIG. 2 is plate-like (with a thickness T) and its marginal contour is symmetrical to a median plane and is arranged in centred manner on the base 3. In stylized form it has a head 6, shoulders 5 with a shoulder width B1 and legs 4. The legs 4 end with a foot width B2 on the base upper surface 7. The foot width B2 is smaller than the shoulder width B1. The marginal contour between the legs 4 and the shoulders 5 is concave. In practice this shaping leads to dynamics of the playing FIG. 1, which in particular in the case off precessing movements can be particularly well controlled and consequently playability is significantly improved. In addition, the playing figure is stabilized in the case of momentum transfer to the ball. This is assisted by the fact that the weight of the FIG. 2 is no more than 12.5% and in particular between 8 and 9% of the weight of the base 3. With a polystyrene base 3 of the indicated density, it has proved appropriate to make the FIG. 2 from Styropor with a density of 60 to 150 g/dm$^3$ or a comparatively light material. As a result of its stylized shape FIG. 2 can be easily printed or painted, so as to be able to obtain different jerseys or shirts and therefore easily distinguishable teams. Within the scope of the invention it is also possible to design the figure differently and in particular so as not to have a plate shape, provided that the size and weight ratios are respected.

Apart from the lack of base rounding 11, the second variant of FIG. 2 has essentially the same dimensions as the variant of FIG. 1. In place of the base rounding the base rim 9 is perpendicular up to the lower surface 10. At the transition between the base rim and the base lower surface 10 is provided a bevel 12, which is intended to ensure that when playing the lower edge of the playing figure does not catch on or get stuck on the substrate serving as the playing surface. Therefore the diameter D2 of the base lower surface 10 is almost 100% of the base diameter D1.

As a result of the lack of the base rounding 11, the playing figure according to FIG. 2 is closer to the playing disk or counter concept. Therefore more specifically staggering movements cannot be performed as easily, although the presence of the mounted, relatively high FIG. 2 favours staggering movements, unlike in the case of the disk alone. However, increased stability is obtained for linear movements, which is advantageous in particular for non-professional players.

In the explanations up to now the dimensions have always only been given as ratio values. The connection with absolute values is obtained on taking account of the following standard dimensions prescribed for playing figures by the International Table Football Federation (FISTF):

Base diameter (D1): 16 to 21 mm

Base height (HI): 5 to 7 mm

Figure width at widest point: 6 to 13 mm

Figure thickness (T): max. 6 mm

Total playing figure weight: 1.4 to 2.8 g

Total playing figure height: 27 to 39 mm

The playing figure is to have a round, i.e. rotationally symmetrical base and the figure and base must be firmly interconnected. Playing takes place with a hollow, spherical plastic ball with a diameter of 22 mm and a weight of 1.5 g.

Although the playing figures have been explained in conjunction with table football, within the scope of the invention it is also conceivable to use them for other types of games, particularly for table ice hockey. The invention provides a playing figure, which has a simple construction and is easy to manufacture, whilst more particularly having especially pronounced and very readily controllable dynamic playing characteristics.

LIST OF REFERENCE NUMERALS

| | |
|---|---|
| 1 | Playing figure |
| 2 | Figure |
| 3 | Base |
| 4 | Legs |
| 5 | Shoulders |
| 6 | Head |
| 7 | Base upper surface |
| 8 | Base upper edge |
| 9 | Base rim |
| 10 | Base lower surface |
| 11 | Base rounding |
| 12 | Bevel |
| B1 | Shoulder width |
| B2 | Foot width |
| B3 | Width (base upper edge) |
| D1 | Base diameter |
| D2 | Diameter (base lower surface) |
| H1 | Base height |
| H2 | Height (figure) |
| H3 | Height (base rim) |
| r | Rounding radius |
| T | Thickness (figure) |
| w | Angle (base upper edge) |

I claim:

1. Playing figure for a table football game, said playing figure (1) having a base (3) rotationally symmetrical about a base axis and having a base diameter (D1) and a base height (H1), as well as a figure (2), the base (3) being bounded on its bottom by a planar base lower surface (10) having a diameter (D2) and on its top by a base upper surface (7) bordered by a base upper edge surface (8) and in which the figure (2) is applied to the base upper surface (7) and extends in the direction of the base axis, wherein the diameter (D2) of the base lower surface (10) is more than 55% and up to substantially 100% of the base diameter (D1);

said base upper edge (8) being inclined in the manner of a bevel and having a width (B3) which is between 15 and 40% of the base height (H1);

said diameter (D2) of the base lower portion (10) being between 57 and 76% of the base diameter (D1);

said base (3) between the base upper edge (8) and the base lower surface (10) being outwardly bounded by a base rounding (11) which is rotationally symmetrical about the base axis, said base rounding (11) having a radius (r);

wherein between the base upper edge (8) and the base rounding (11) is provided a perpendicular base rim (9) which is rotationally symmetrical about the base axis, said base rim (9) having a height (H3) which is 3 to 30% of the base height (H1).

2. Playing figure for a table football game, said playing figure (1) having a base (3) rotationally symmetrical about a base axis and having a base diameter (D1) and a base height (H1), as well as a figure (2), the base (3) being bounded on its bottom by a planar base lower surface (10) having a diameter (D2) and on its top by a base upper surface (7) bordered by a base upper edge surface (8) and in which the figure (2) is applied to the base upper surface (7) and extends in the direction of the base axis, wherein the diameter (D2) of the base lower surface (10) is more than 55% and up to substantially 100% of the base diameter (D1);

said base upper edge (8) being inclined in the manner of a bevel and having a width (B3) which is between 15 and 40% of the base height (H1);

wherein the diameter (D2) of the base lower surface (10) is substantially 100% of the base diameter (D1); and wherein between the base upper edge (8) and the base lower surface (10) is provided a perpendicular base rim (9) which is rotationally symmetrical about the base axis and which links the base upper edge (8) to the base lower surface (10).

3. Playing figure according to claim 2, wherein a bevel (12) is provided at the transition between the base rim (9) and the base lower surface (10).

4. A ball game playable on a table having active playing figures, each of said playing figures having means for kicking or passing a spherical ball or a puck upon being snapped forward by the finger of a player, each of said playing figures (1) further having a base (3) rotationally symmetrical about a base axis and having a base diameter (D1) and a base height (H1), as well as a figure (2), the base (3) consisting of a single material, the base (3) being bounded on its bottom by a planar base lower surface (10) having a diameter (D2) and on its top by a base upper surface (7) bordered by a base upper edge surface (8) and in which the figure (2) is applied to the base upper surface (7) and extends in the direction of the base axis, the planar base lower surface (10) for engaging the table, wherein the diameter (D2) of the base lower surface (10) is more than 55% and up to substantially 100% of the base diameter (D1); and wherein said means for kicking or passing a spherical ball or puck comprises said base (3) and the base upper edge (8) is inclined having a width (B3) which is between 15 and 40% of the base height (H1).

5. A ball game playable on a table having active playing figures, each of said playing figures having means for kicking or passing a spherical ball or a puck upon being snapped forward by the finger of a player, each of said playing figures (1) further having a base (3) rotationally symmetrical about a base axis and having a base diameter (D1) and a base height (Hi), as well as a figure (2), the base (3) being bounded on its bottom by a planar base lower surface (10) having a diameter (D2) and on its top by a base upper surface (7) bordered by a base upper edge surface (8) and in which the figure (2) is applied to the base upper surface (7) and extends in the direction of the base axis, wherein the diameter (D2) of the base lower surface (10) is more than 55% and up to substantially 100% of the base diameter (D1); and wherein said means for kicking or passing a spherical ball or puck comprises said base (3) and the base upper edge (8) is inclined in the manner of a bevel having a width (B3) which is between 15 and 40% of the base height (H1).

6. Playing figure according to claim 5, wherein the width (B3) of the base upper edge (8) is approximately 27% of the base height (H1).

7. Playing figure according to claim 5, wherein the diameter (D2) of the base lower portion (10) is between 57 and 76% of the base diameter (D1).

8. Playing figure according to claim 7, wherein the diameter (D2) of the base lower portion (10) is approximately 66% of the base diameter (D1).

9. Playing figure according to claim 5, wherein the diameter (D2) of the base lower surface (10) is substantially 100% of the base diameter (D1).

10. Playing figure according to claim 7, wherein the base (3) between the base upper edge (8) and the base lower surface (10) is outwardly bounded by a base rounding (11) which is rotationally symmetrical about the base axis, said base rounding (11) having a radius (r).

11. Playing figure according to claim 10, wherein the radius (r) of the base rounding (11) is approximately 38% of the base diameter (D1).

12. Playing figure according to claim 10, wherein between the base upper edge (8) and the base rounding (11) is provided a perpendicular base rim (9) which is rotationally symmetrical about the base axis, said base rim (9) having a height (H3) which is 3 to 30% of the base height (H1).

13. Playing figure according to claim 12, wherein the height (H3) of the base rim (9) is approximately 3.6% of the base height (H1).

14. Playing figure according to claim 9, wherein between the base upper edge (8) and the base lower surface (10) is provided a perpendicular base rim (9) which is rotationally symmetrical about the base axis and which links the base upper edge (8) to the base lower surface (10).

15. Playing figure according to claim 14, wherein a bevel (12) is provided at the transition between the base rim (9) and the base lower surface (10).

16. Playing figure according to claim 6, wherein the base upper edge (8) forms with the horizontal an angle (w) between 40 and 80 degrees.

17. Playing figure according to claim 16, wherein the angle (w) is approximately 61.5 degrees.

* * * * *